US010470542B2

(12) United States Patent
Ramirez et al.

(10) Patent No.: US 10,470,542 B2
(45) Date of Patent: Nov. 12, 2019

(54) DEVICES AND METHODS FOR MOUNTING MOBILE COMPUTING DEVICES TO OBJECTS FOR HANDS-FREE VIEWING

(71) Applicants: Richard G. Ramirez, Montrose, NY (US); Marissa L. Gaster, New York, NY (US); Brent Kleinman, New York, NY (US)

(72) Inventors: Richard G. Ramirez, Montrose, NY (US); Marissa L. Gaster, New York, NY (US); Brent Kleinman, New York, NY (US)

( * ) Notice: Subject to any disclaimer, the term of this patent is extended or adjusted under 35 U.S.C. 154(b) by 130 days.

(21) Appl. No.: 15/649,449

(22) Filed: Jul. 13, 2017

(65) Prior Publication Data

US 2018/0055170 A1 Mar. 1, 2018

Related U.S. Application Data

(60) Provisional application No. 62/381,727, filed on Aug. 31, 2016.

(51) Int. Cl.

| | |
|---|---|
| ***A45C 13/00*** | (2006.01) |
| ***A45C 11/00*** | (2006.01) |
| ***A45F 5/00*** | (2006.01) |

(52) U.S. Cl.

CPC ..... *A45C 13/001* (2013.01); *A45C 11/00* (2013.01); *A45C 13/002* (2013.01); *A45C 13/005* (2013.01); *A45F 5/00* (2013.01); *A45C 2011/002* (2013.01); *A45C 2011/003* (2013.01); *A45C 2200/15* (2013.01)

(58) Field of Classification Search

USPC ..... 248/205.3

See application file for complete search history.

(56) References Cited

U.S. PATENT DOCUMENTS

| | | | | | |
|---|---|---|---|---|---|
| 3,409,257 | A * | 11/1968 | Elm | F16L 3/08 | 248/205.3 |
| 3,885,768 | A * | 5/1975 | Frye | A47G 1/17 | 108/152 |
| 4,310,137 | A * | 1/1982 | Frye | F16B 47/003 | 248/205.3 |
| 4,948,022 | A * | 8/1990 | VanDyke | B60R 7/088 | 206/308.1 |
| 5,850,954 | A * | 12/1998 | Dong-Joo | H04M 1/04 | 224/197 |
| 6,170,955 | B1 * | 1/2001 | Campbell | B60R 11/04 | 248/208 |

(Continued)

*Primary Examiner* — Monica E Millner

(74) *Attorney, Agent, or Firm* — Frank V. DeRosa; Ryan, Mason & Lewis, LLP

(57) ABSTRACT

Devices and methods are provided for mounting mobile computing devices, such as smart phones, electronic tablets, etc., to objects for hand-free viewing. For example, a cover assembly for a mobile computing device includes a protective cover configured to connect to a mobile computing device, and an adhesive film stack coupled to a backside of the first protective cover. The adhesive film stack includes a stack of individual dry adhesive strips, wherein each individual dry adhesive strip is configured to adhere to a surface of a target object to mount the protective cover to the surface of the object with the mobile computing device attached to the protective cover.

16 Claims, 9 Drawing Sheets

(56) References Cited

U.S. PATENT DOCUMENTS

| | | | | |
|---|---|---|---|---|
| 6,550,108 | B2 * | 4/2003 | Pratl | H04B 1/3833 24/115 K |
| 8,998,049 | B1 * | 4/2015 | Orr | B60R 11/0258 224/483 |
| 9,602,640 | B1 * | 3/2017 | Ham | H04M 1/0258 |
| 2002/0100782 | A1 | 8/2002 | Marvin | |
| 2008/0197246 | A1 * | 8/2008 | Belden | A47F 13/00 248/176.1 |
| 2008/0311369 | A1 * | 12/2008 | Yokoyama | B32B 7/12 428/220 |
| 2011/0290965 | A1 * | 12/2011 | Virgin | G06F 1/1632 248/205.3 |
| 2014/0037867 | A1 | 2/2014 | Wheatley et al. | |
| 2015/0305502 | A1 * | 10/2015 | Wengreen | A47B 97/00 248/205.3 |
| 2015/0366336 | A1 * | 12/2015 | Wong | F16M 11/14 248/371 |
| 2015/0382489 | A1 * | 12/2015 | Sorensen | G06F 1/16 248/558 |
| 2016/0002514 | A1 | 1/2016 | Determan et al. | |
| 2016/0088134 | A1 | 3/2016 | Mathew | |
| 2016/0109059 | A1 * | 4/2016 | Richards, III | F16B 11/006 248/205.3 |
| 2016/0167853 | A1 * | 6/2016 | Gallup | A47G 29/10 248/205.2 |

* cited by examiner

DEVICES AND METHODS FOR MOUNTING MOBILE COMPUTING DEVICES TO OBJECTS FOR HANDS-FREE VIEWING

CROSS-REFERENCE TO RELATED APPLICATION

This application claims priority to U.S. Provisional Application Ser. No. 62/381,727, filed on Aug. 31, 2016, the disclosure of which is incorporated herein by reference.

TECHNICAL FIELD

This disclosure generally relates to protective cover assembles for mobile computing devices.

BACKGROUND

With continuing advances in mobile computing technologies, the use of mobile computing devices such as smart phones, electronic tablets, and other types of personal digital assistance (PDA) devices is becoming increasingly pervasive. These mobile computing devices are used for a multitude of purposes, including, for example, teleconferencing, video conferencing, e-mail, text messaging, streaming media, etc. With streaming media applications, individuals can access content over the Internet to watch videos, television shows, etc., for purposes of entertainment. Typically, individuals will watch videos, television shows, and other streaming media content while traveling in a car, train, airplane, etc. However, when viewing streaming media content on a display of a mobile computing device such as a smart phone, an individual must hold the device, or otherwise rest the device on his/her lap, for example, while viewing the displayed streaming media content. This can be very inconvenient when watching a long movie, for example, since the individual cannot position the mobile device at eye level, and must look down at the mobile computing device which is either held in hand or resting on the individual's lap.

SUMMARY

Embodiments of the invention include devices and methods for mounting mobile computing devices, such as smart phones, electronic tablets, etc., to objects for hand-free viewing, and, in particular, protective cover assembles for mobile computing devices, which are configured to enable mounting of mobile computing devices to objects for hands-free viewing.

For example, one embodiment includes a cover assembly for a mobile computing device, which comprises a first protective cover configured to connect to a mobile computing device, and an adhesive film stack coupled to a backside of the first protective cover. The adhesive film stack comprises a stack of individual dry adhesive strips, wherein each individual dry adhesive strip is configured to adhere to a surface of a target object to mount the first protective cover to the surface of the object with the mobile computing device attached to the first protective cover.

In another embodiment, the cover assembly further comprises a second protective cover which is configured to connect to the first protective cover and cover the backside of the first protective cover. The second protective cover comprises a cavity region formed in an inner surface of the second protective cover. The cavity region is configured to insertably receive the adhesive film stack when the second protective cover is mounted to the first protective cover.

In another embodiment, a cover assembly for a mobile computing device comprises a first protective cover configured to connect to a mobile computing device, and an adhesive film stack coupled to a backside of the first protective cover. The first protective cover comprises a cavity region formed in the backside of the protective cover, and a movable cover to open and close the cavity region. The cavity region is configured to store the adhesive film stack when the movable cover is positioned to close the cavity region. The adhesive film stack comprises a stack of individual dry adhesive strips, wherein each individual dry adhesive strip is configured to adhere to a surface of a target object to mount the first protective cover to the surface of the object with the mobile computing device attached to the first protective cover. In one embodiment, the movable cover is slidable. In another embodiment, the movable cover is hingedly connected to the backside of the first protective cover, wherein the adhesive film stack is mounted to an inside surface of the movable cover.

In another embodiment, a cover assembly for a mobile computing device comprises a first protective cover configured to connect to a mobile computing device, and an adhesive film stack coupled to a backside of the first protective cover. The first protective cover comprises a first and second slot formed on the backside of the first protective cover. The adhesive film stack is mounted to a flexible substrate member. The adhesive film stack is coupled to the backside of the first protective cover by inserting first and second end portions of the flexible substrate member into the first and second slots, respectively, on the backside of the first protective cover. The adhesive film stack comprises a stack of individual dry adhesive strips, wherein each individual dry adhesive strip is configured to adhere to a surface of a target object to mount the first protective cover to the surface of the object with the mobile computing device attached to the first protective cover.

Another embodiment includes a method which comprises connecting a first protective cover to a mobile computing device, applying a dry adhesive strip to a backside of the first protective cover, and pressing the dry adhesive strip against a surface of an object to mount the first protective cover to the surface of the object with the mobile computing device attached to the first protective cover.

Other embodiments will be described in the following detailed description of embodiments, which is to be read in conjunction with the accompanying figures.

DETAILED DESCRIPTION OF EMBODIMENTS

Embodiments will now be described in further detail with regard to devices and methods for mounting mobile computing devices, such as smart phones, electronic tablets, etc., to objects for hand-free viewing, and, in particular, protective cover assembles for mobile computing devices, wherein the protective cover assemblies are configured to enable mounting of mobile computing devices to objects for hands-free viewing.

It is to be understood that the various components, structures, and layers shown in the accompanying drawings are schematic illustrations that are not drawn to scale. Moreover, the same or similar reference numbers are used throughout the drawings to denote the same or similar features, elements, or structures, and thus, a detailed explanation of the same or similar features, elements, or structures will not be repeated for each of the drawings. It is to be understood that the terms "about" or "substantially" as used herein with regard to thicknesses, widths, percentages, ranges, etc., are meant to denote being close or approximate to, but not exactly. For example, the term "about" or "substantially" as used herein implies that a small margin of error is present, such as 1% or less than the stated amount.

Figure 1A:
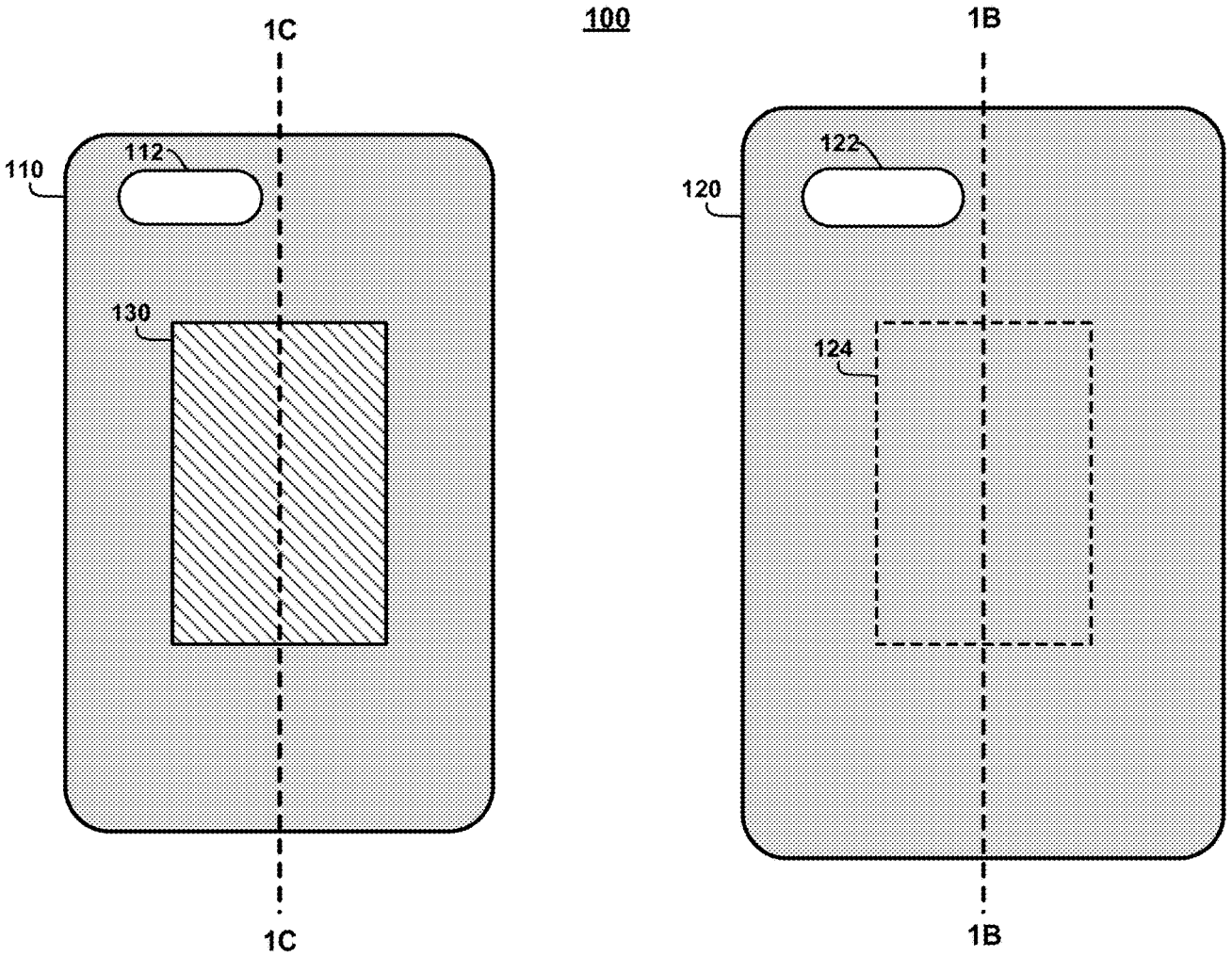
FIGS. 1A, 1B, 1C, 1D, and 1E schematically illustrate a protective cover assembly for a mobile computing device which enables mounting of the mobile computing device to an object, according to an embodiment of the invention.
Figure 1B:
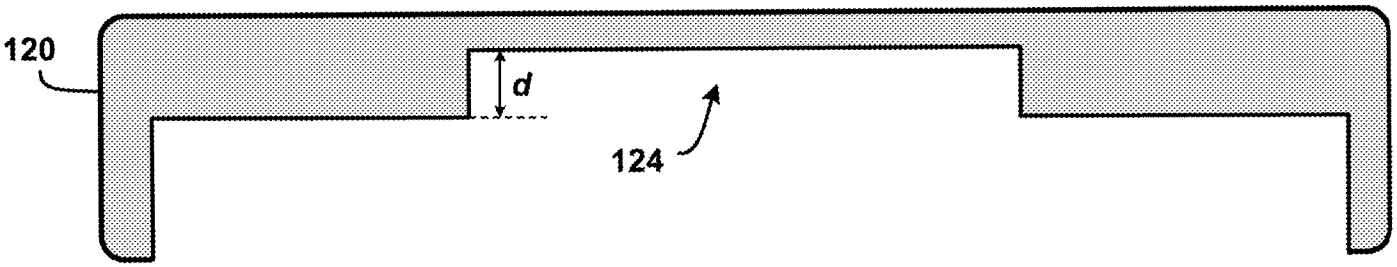
Figure 1C:
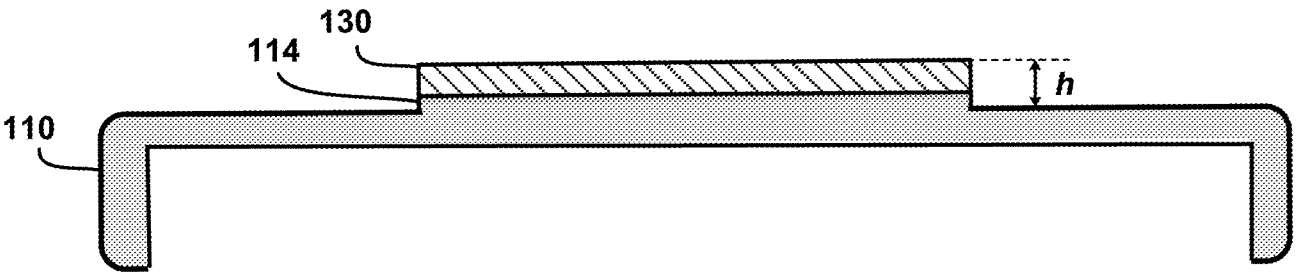
Figure 1D:
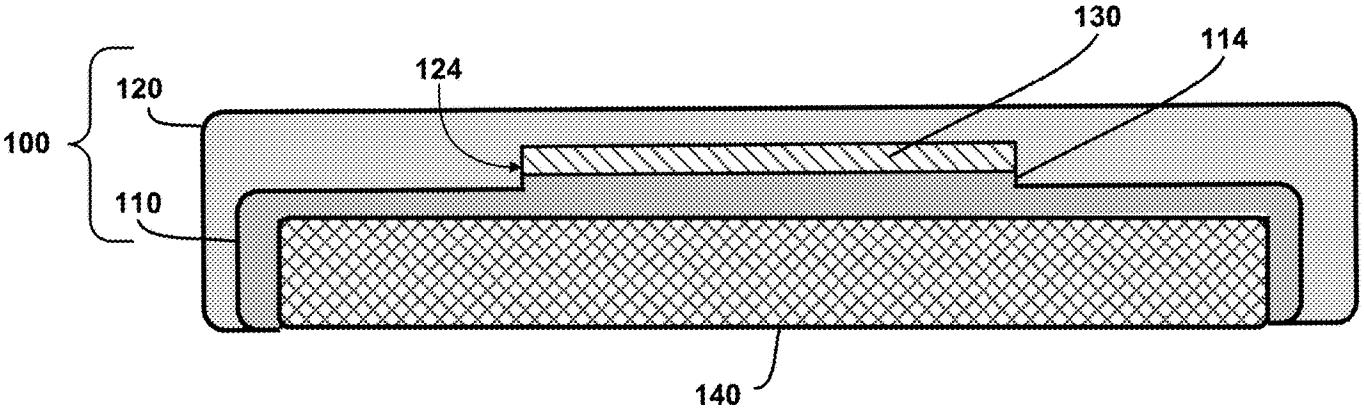

FIGS. 1A, 1B, 1C, 1D, and 1E schematically illustrate a protective cover assembly for a mobile computing device which enables mounting of the mobile computing device to an object, according to an embodiment of the invention. More specifically, FIG. 1A schematically illustrates a cover assembly 100 comprising a flexible cover member 110 and a rigid cover member 120. FIG. 1B is a schematic cross-sectional view of the rigid cover member 120 taken along line 1B-1B shown in FIG. 1A, and FIG. 1C is a schematic cross-sectional view of the flexible cover member 110 taken along line 1C-1C shown in FIG. 1A. FIG. 1D is a schematic cross-sectional view showing the rigid cover member 120 and the flexible cover member 110 of the cover assembly 100 connected together, with the cover assembly 100 mounted to a mobile computing device 140, e.g., a smart phone. The flexible cover member 110 may be formed of a rubber material, and the rigid cover member 120 can be formed of a rigid or semi-rigid plastic material, or other materials that are commonly utilized to fabricate protective covers for mobile computing devices.

As shown in FIG. 1A, the flexible cover member 110 and the rigid cover member 120 comprise openings 112 and 122, respectively, which are aligned with each other when the cover members 110 and 120 are coupled together to provide an opening for, e.g., a camera lens and flash element, which are commonly found on the back side of mobile computing devices such as smart phones and electronic tablets. As further shown in FIGS. 1A and 1C, the flexible cover member 110 comprises a raised flat platform (or mesa) 114 on the backside surface of the flexible cover member 110. The mesa 114 provides a platform on which an adhesive film stack 130 can be adhered to the backside of the flexible cover member 110.

Moreover, as shown in FIGS. 1A and 1B, the rigid cover member 120 comprises a cavity 124 formed within an inner surface of the rigid cover member 120. The cavity 124 comprises a depth d. The mesa 114 and cavity 124 are positionally fabricated in alignment with each other. The mesa 114 comprises a footprint (2D area) that is dimensioned (and positioned) to allow the mesa 114 to fit within the cavity 124 when the cover members 110 and 120 are assembled together (as shown in FIG. 1D). Furthermore, the adhesive film stack 130 comprises a footprint that is the same or slightly less than the footprint of the mesa 114. As shown in FIG. 1C, the adhesive film stack 130 and mesa 114 have a combined height h which is no greater than the depth d of the cavity 124.

Figure 1E:
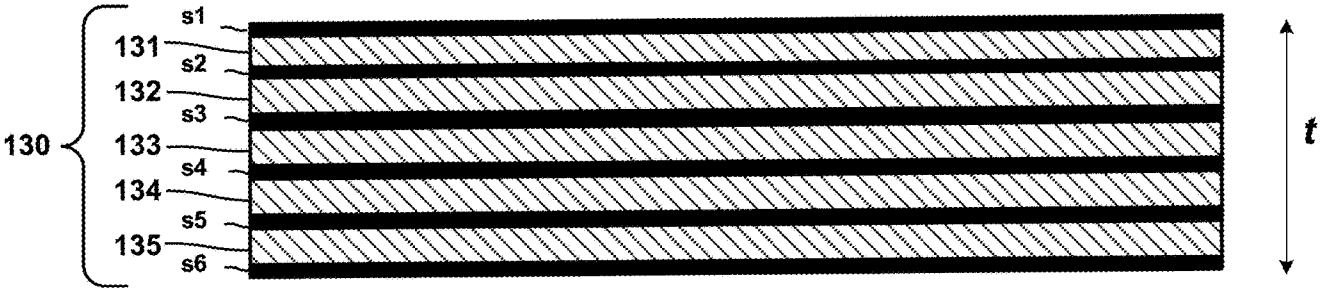

FIG. 1E is a schematic side view of the adhesive film stack 130 according to an embodiment of the invention. The adhesive film stack 130 comprises a plurality of dry adhesive strips 131, 132, 133, 134, and 135, and a plurality of thin non-stick separation layers s1, s2, s3, s4, s5, and s6. In one embodiment, the thin separation layers s1~s6 are formed of a thin plastic film, which serve to separate the adhesive surfaces of adjacent dry adhesive strips 131, 132, 133, 134, and 135, and to cover the outer surfaces of the top and bottom strips 131 and 135.

As shown in FIG. 1E, the adhesive film stack 130 comprises a thickness t, wherein in one embodiment, the thickness t is in a range of about 5 millimeters to about 10 millimeters. In the example embodiment of FIG. 1E, the adhesive film stack 130 comprises five removable/disposable dry adhesive strips 13~135, each of which are used once in conjunction with the flexible cover member 110, to removably mount a mobile computing device to the surface of an object. For example, in one embodiment, the adhesive film stack 130 and flexible cover member 110 are utilized to mount the mobile computing device 140 to the surface of an object as follows.

In the example embodiment of FIG. 1E, the bottom separation layer S6 is peeled off the bottom surface of dry adhesive strip 135, and the adhesive film stack 130 is mounted to the mesa 114 of the flexible cover member 110 by adhering the exposed bottom surface of the adhesive strip 135 to the surface of the mesa 114. At this point, the flexible cover member 110 is either already attached, or then attached, to the mobile computing device 140. Then, the upper most separation layer (e.g., separation layer s1 in FIG. 1E) is removed to expose the underlying dry adhesive strip (e.g., strip 131).

Figure 1F:
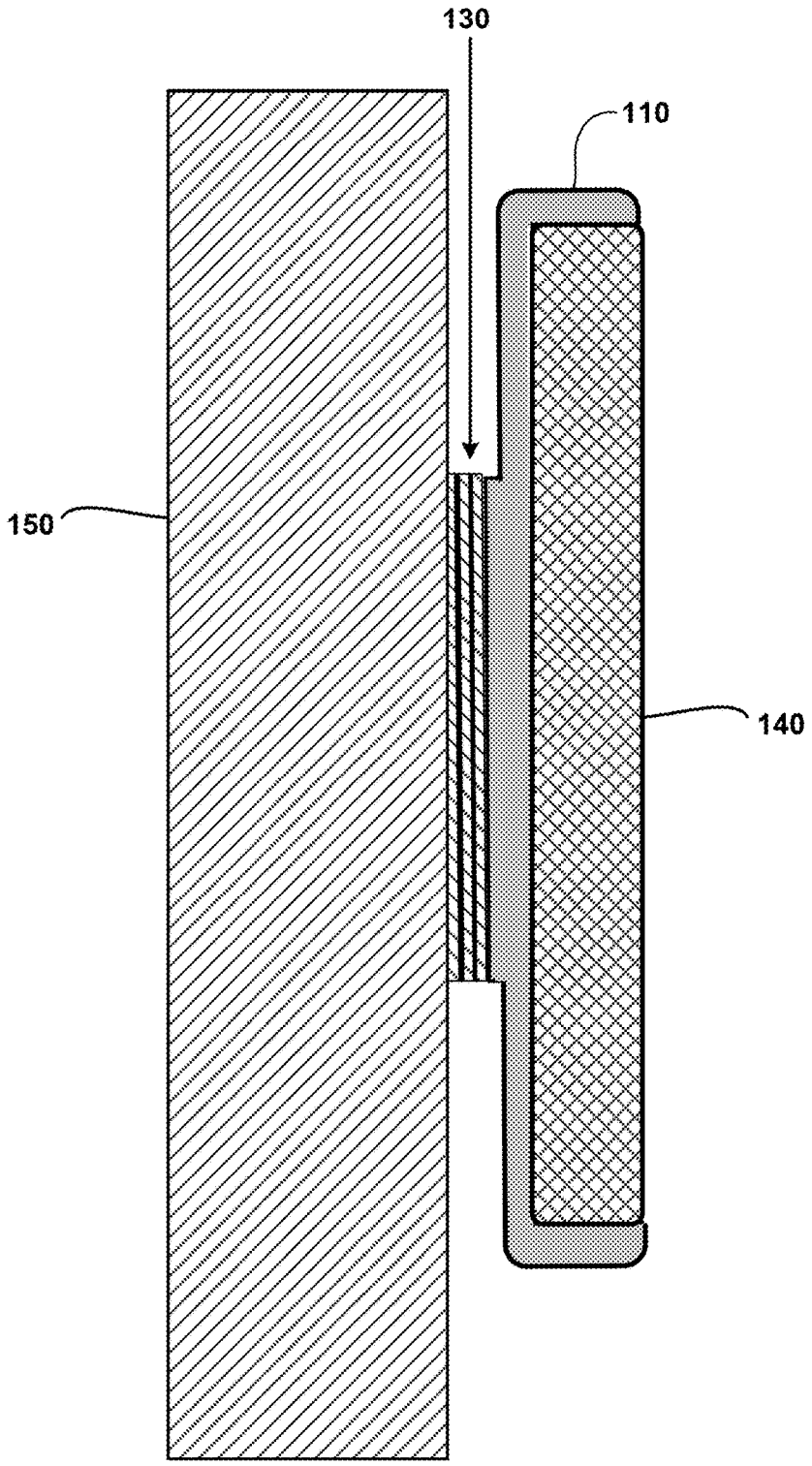
FIG. 1F schematically illustrates a method for mounting a mobile computing device to a surface of an object using a cover member and adhesive film stack of the cover assembly illustrated in FIGS. 1A, 1B, 1C, 1D, and 1E, according to an embodiment of the invention.

Then, referring to FIG. 1F, the mobile computing device 140 with the flexible cover 110 mounted thereon, is mounted to the surface of a given object 150 using the exposed surface of the uppermost remaining dry adhesive strip (e.g., strip 131) of the adhesive film stack 130. In the example embodiment of FIG. 1F, the object 150 may be, for example, the backside surface of a seat of an airplane or train, or the dashboard of a car, etc. To remove/demount the assembly 110/130/140 from the surface of the object 150, the individual would push/pull the assembly down in a direction lateral to the surface of the object 150 to essentially stretch the currently used dry adhesive strip, and release the adhesive strip from the remaining layers of the adhesive film stack 130. The individual would then peel-off the used adhesive strip from the surface of the object 150.

To protect the remaining layers of the adhesive film stack 130 connected to the mesa 114 of the flexible cover member 110, the individual would connect the rigid cover member 120 to the back of the flexible cover member 110, so that the remaining layers of the adhesive film stack would be protected within the cavity 124 of the rigid cover member 120. The individual could then use the mobile computing device 140 with the protective cover assembly 100 connected to the mobile computing device 140. Thereafter, if the individual wants to mount the mobile computing device 140 to the surface of some other object at a later time, the individual would remove the rigid cover member 120 from the flexible cover member 110 to expose the remaining portion of the adhesive film stack 130, and then remove the upper most separation layer (e.g., s2) to expose the next underlying dry adhesive strip (assuming that the upper most separation layer was not already peeled from the next underlying dry adhesive strip as a result of the previous demounting operation).

In this manner, the individual can reuse the adhesive film stack 130 as many times as the number of dry adhesive strips in the initial (unused) adhesive film stack 130. For example, in the example embodiment of FIG. 1E, since the unused adhesive film stack 130 comprises five (5) dry adhesive strips 131~135, the adhesive film stack 130 can be used for 5 mounting operations. When the last dry adhesive strip 135 is used, a new (unused) adhesive film stack 130 can be adhered to the mesa 114 of the flexible cover member 110 for further mounting operations.

The adhesive film stack 130 can be fabricated using any one of commercially available dry adhesive technologies, which are suitable for the given application. For example, in one embodiment, the dry adhesive strips 131~135 of the adhesive film stack 130 can be implemented using a commercially available stretch releasing pressure sensitive dry adhesive tape, which does not leave behind adhesive residue when removed from a surface. In one particular embodiment, the dry adhesive strips 131~135 of the adhesive film stack 130 can be implemented using a currently evolving dry adhesive technology which is based on the use of synthetic adaptations/emulations of the setae (microscopic hairs) of gecko's feet. In general, such synthetic designs (e.g., synthetic setae) comprise nano-level, geometric structures that emulate the setae of gecko feet by forming molecular-level bonds (known as Van der Waal's forces) with a mating surface. Dry adhesive films that are fabricated with such technology provide very strong, residue-free, bonding solutions. This is in contrast to other types of adhesives which create chemical bonds that are tacky and leave adhesive residue, which are not desirable for use in the exemplary embodiments described herein.

In an alternative embodiment of the invention shown in FIGS. 1B and 1C, for example, instead of utilizing the adhesive film stack 130 with a plurality of disposable dry adhesive strips, the raised mesa 114 of the flexible cover 110 may be formed of, or otherwise comprise, a specialized adhesive nano-structure or nano-coating (formed using any known or future adhesion nanotechnology), which allows a mobile computing device to be mounted to an object using the flexible cover 110. In this alternative embodiment, the raised mesa 114 which is integrally formed with the flexible cover 110, would serve as a reusable adhesion member to adhere the mobile computing device to an object with the flexible cover 110 connected to the device. When not in use, the rigid cover 120 (with the protective cavity 124) can be used to cover the flexible cover 110 wherein the reusable nano-adhesive mesa 114 would be protected within the cavity 124 when not in use. To maintain the adhesive strength, the reusable nano-adhesive mesa 114 would be periodically cleaned using a suitable cleaning solution to remove dirt or debris from the nano-adhesive mesa 114 to maintain the adhesive strength of the reusable nano-adhesive mesa 114.

Figure 2B:
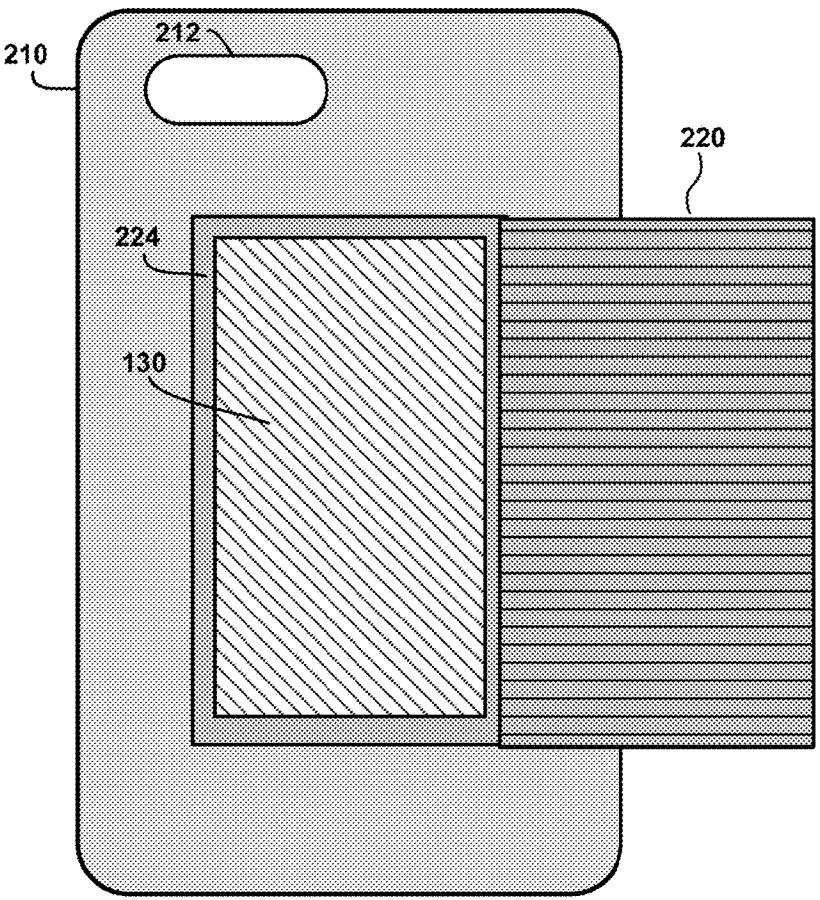
FIGS. 2A and 2B schematically illustrate a protective cover assembly for a mobile computing device which enables mounting of the mobile computing device to an object, according to another embodiment of the invention.
Figure 2A:
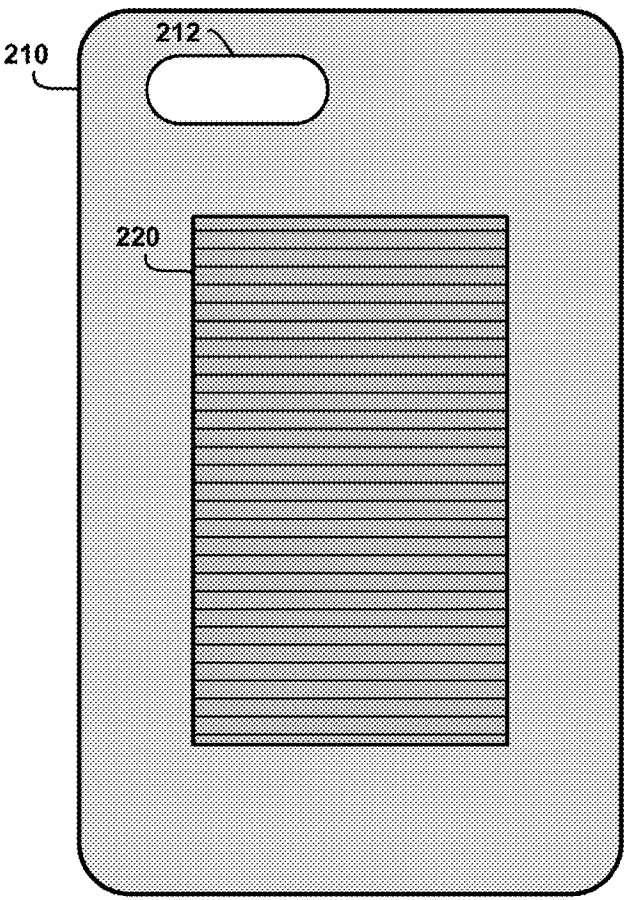

FIGS. 2A and 2B schematically illustrate a protective cover assembly for a mobile computing device which enables mounting of the mobile computing device to an object, according to another embodiment of the invention. In particular, FIGS. 2A and 2B schematically illustrate a cover assembly 200 comprising a rigid cover member 210, which comprises an opening 212, a slidable cover 220, and a cavity 224 formed in a backside surface of the rigid cover member 210. The cavity 224 is configured to store an adhesive film stack (e.g., stack 130, FIG. 1E), or a plurality of individual pieces of dry adhesive strips. The slidable cover 220 can be opened to expose the dry adhesive strips within the cavity 224, and closed to retain the dry adhesive strips within the cavity 224.

The rigid cover member 210 can be coupled to the backside of a mobile computing device wherein the opening 212 allows a camera lens and flash to be exposed. With the rigid cover member 210 connected to the mobile computing device, a person can utilize one of the dry adhesive strips stored in the cavity 224 to mount the assembly (rigid cover member 210 with mobile device) to the surface of an object. For example, in one embodiment, the person can (i) slide open the cover 220 (as shown in FIG. 2B), (ii) remove a dry adhesive strip from the cavity 224, (iii) close the slidable cover 220, (iv) adhere the dry adhesive strip to the outer surface of the slidable cover 220, and then (v) mount the rigid cover member 210 (with the mobile computing device attached thereto) to a desired object. The assembly can then be demounted as discussed above.

Figure 3B:
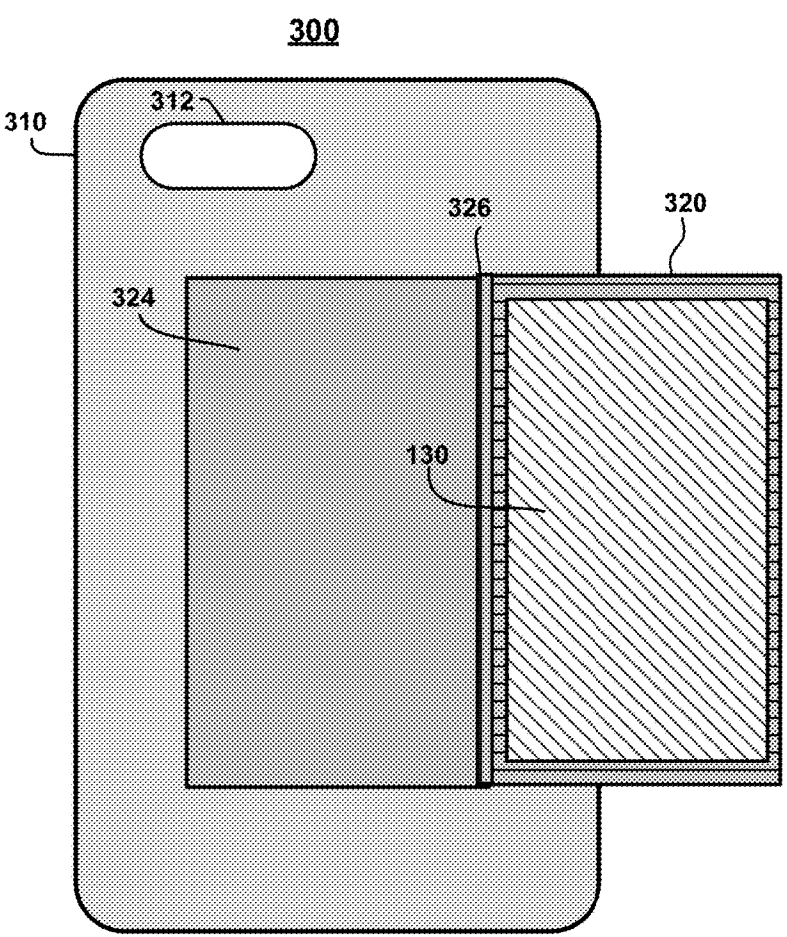
FIGS. 3A and 3B schematically illustrate a protective cover assembly for a mobile computing device which enables mounting of the mobile computing device to an object, according to yet another embodiment of the invention.
Figure 3A:
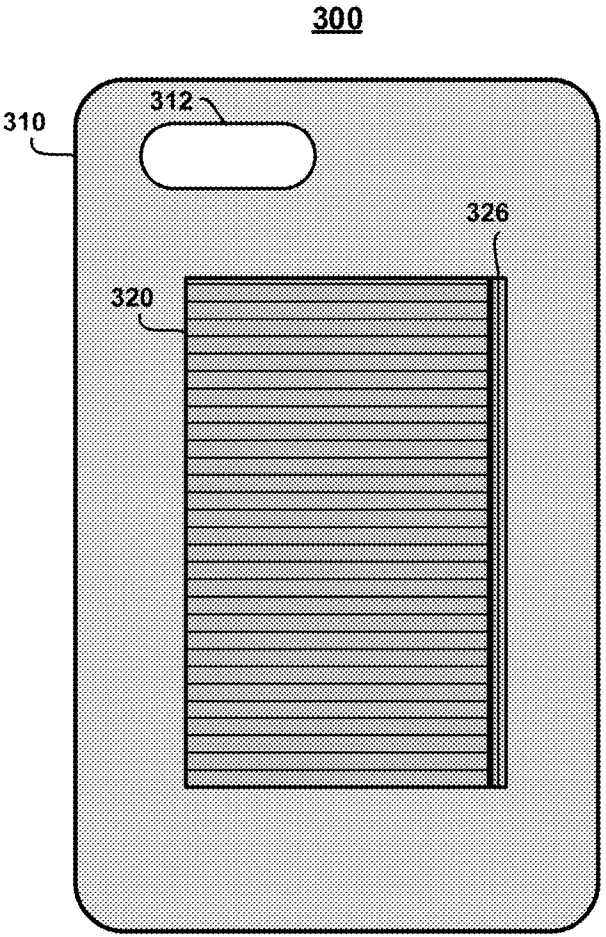

FIGS. 3A and 3B schematically illustrate a protective cover assembly for a mobile computing device which enables mounting of the mobile computing device to an object, according to yet another embodiment of the invention. In particular, FIGS. 3A and 3B schematically illustrate a cover assembly 300 comprising a rigid cover member 310, which comprises an opening 312 (for a camera lens/flash), a hinged cover 320, a hinge member 326, and a cavity 324 formed in a backside surface of the rigid cover member 310.

In this embodiment, as shown in FIG. 3B, the adhesive film stack 130 can be bonded to an inside surface of the hinged cover 320 so that when the hinged cover is closed (FIG. 3A), the adhesive film stack 130 is retained within the cavity 324, and when the hinged cover is opened (FIG. 3B), an upper-most adhesive strip of the adhesive film stack 130 can be bonded to the surface of a target object. In this embodiment, the hinged cover 320 (in an opened state, FIG. 3B) is bonded to the surface of the target object, and the rigid cover member 310 (connected to the mobile computing device) is essentially hanging on the target object from the hinged cover 320.

Figure 4B:
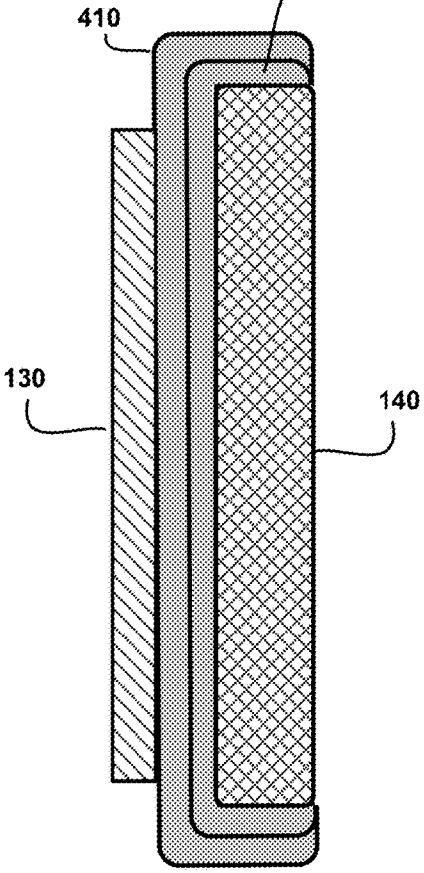
FIGS. 4A and 4B schematically illustrate a protective cover assembly for a mobile computing device which enables mounting of the mobile computing device to an object, according to another embodiment of the invention.
Figure 4A:
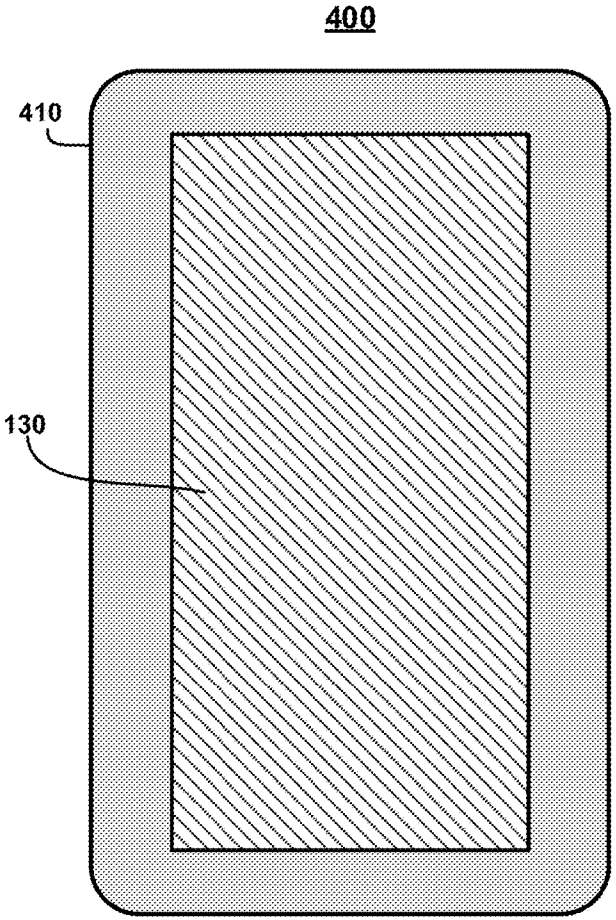

FIGS. 4A and 4B schematically illustrate a protective cover assembly for a mobile computing device which enables mounting of the mobile computing device to an object, according to another embodiment of the invention. In particular, FIG. 4A schematically illustrates a cover assembly 400 comprising a rigid cover member 410 and an adhesive film stack 130 bonded to a backside surface of the rigid cover member 410. Furthermore, as shown in FIG. 4B, the rigid cover member 410 is configured to attach to an assembly 140/420, which comprises an existing (third-party) protective cover 420 connected to mobile computing device 140, to thereby provide a mechanism for mounting the assembly 410/420 to the surface of an object.

Figure 5A:
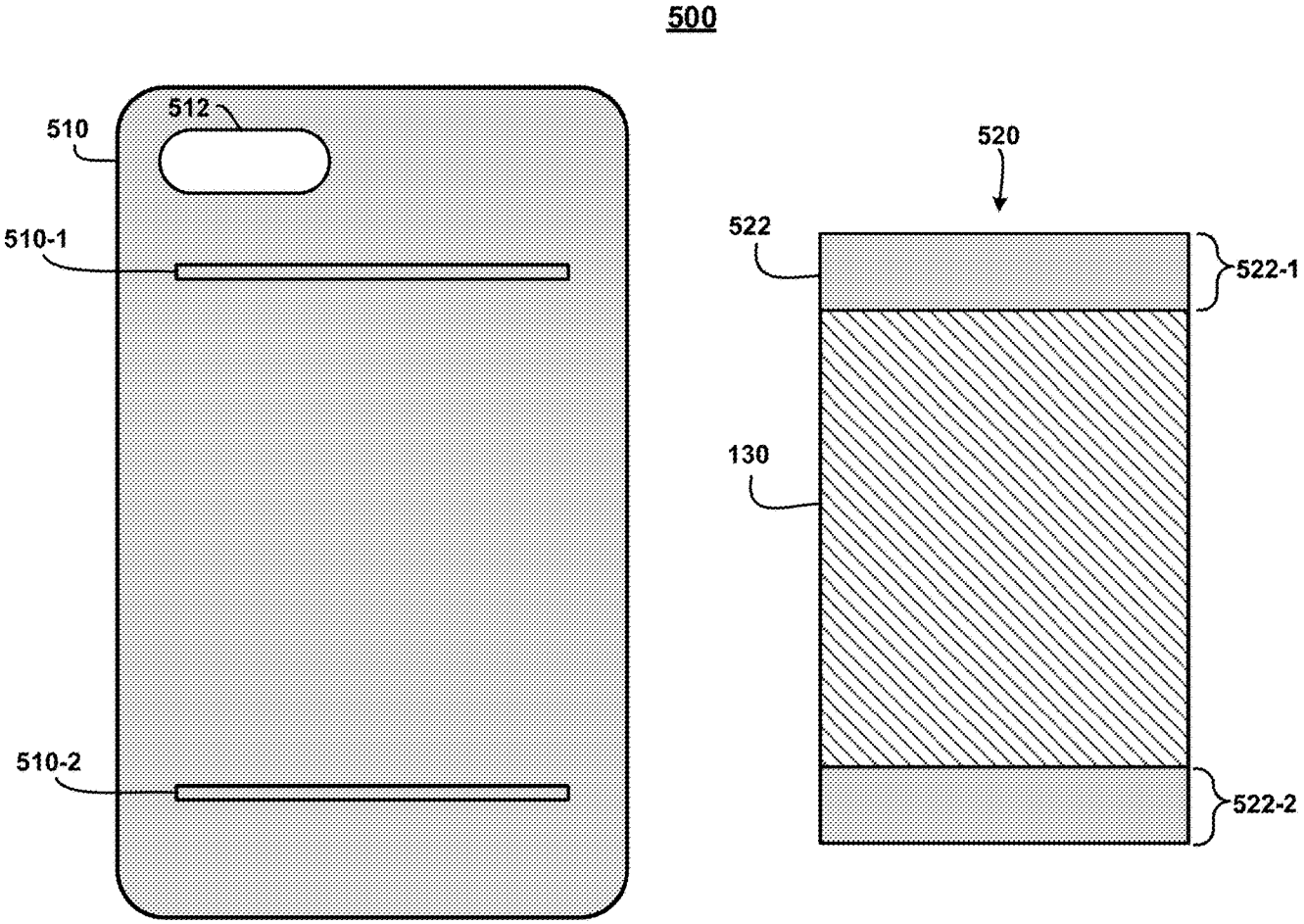
FIGS. 5A and 5B schematically illustrate a protective cover assembly for a mobile computing device which enables mounting of the mobile computing device to an object, according to yet another embodiment of the invention.
Figure 5B:
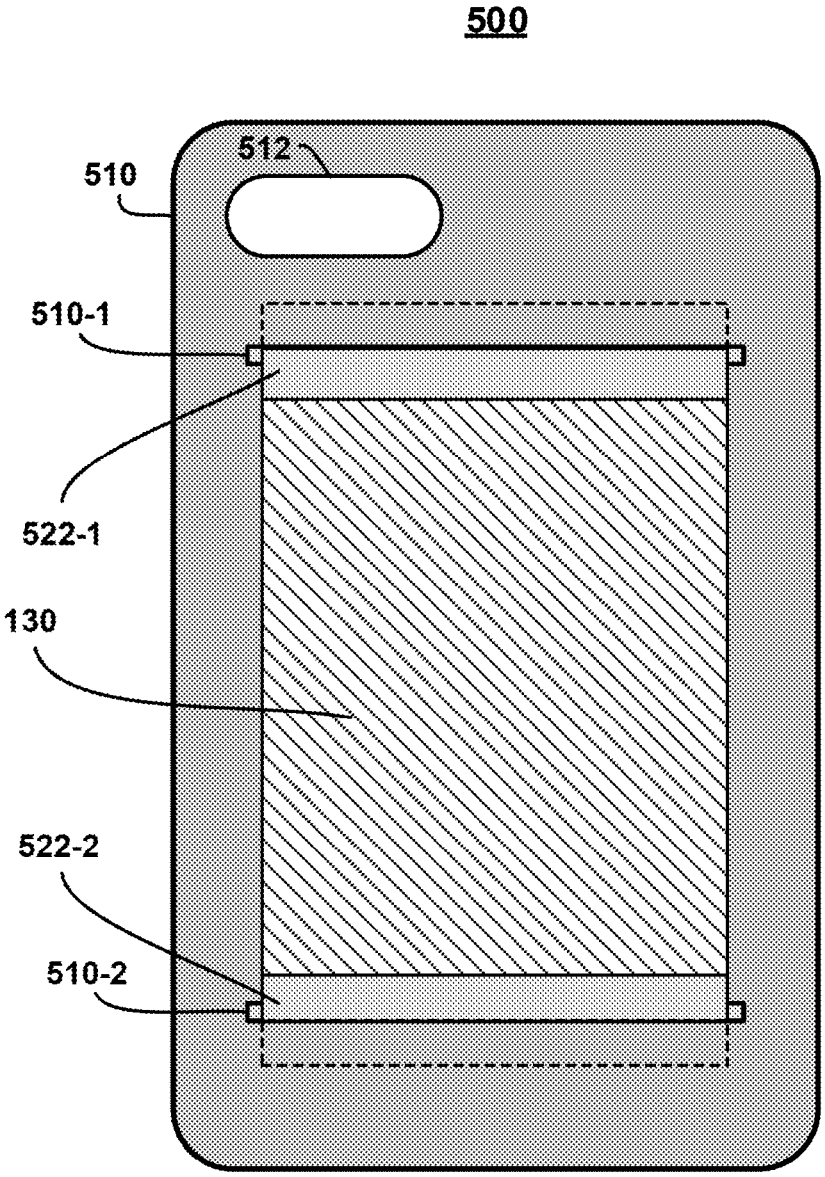

FIGS. 5A and 5B schematically illustrate a protective cover assembly for a mobile computing device which enables mounting of the mobile computing device to an object, according to yet another embodiment of the invention. In particular, FIG. 5A schematically illustrates a cover assembly 500 comprising a rigid (or semi-rigid) cover member 510 and an adhesive mounting member 520. The cover member 510 comprises an opening 512 (for a camera lens and flash), and a pair of slots 510-1 and 510-2 formed in the backside surface of the cover member 510. The adhesive mounting member 520 comprises a flexible substrate 522, and an adhesive film stack 130 mounted to a surface of the flexible substrate 522. First and second end portions 522-1 and 522-2 of the flexible substrate 522 are utilized as "anchors" to removably attach the adhesive mounting member 520 to the backside of the cover member 510 by inserting the first and second end portions 522-1 and 522-2 into the first and second slots 510-1 and 510-2, respectively.

For example, FIG. 5B schematically illustrates an assembly in which the adhesive mounting member 520 is coupled to the backside of the cover member 510 by inserting the first end portion 522-1 of the flexible substrate 522 into the first slot 510-1, and inserting the second end portion 522-2 of the flexible substrate 522 into the second slot 510-2. In this assembled configuration, the cover member 510 can be connected to a mobile computing device, and a dry adhesive strip of the adhesive film stack 130 can be utilized to mount the assembly to a surface of a given object.

In one embodiment of the invention, the flexible substrate 522 can be formed of a thin flexible laminate, a thin plastic sheet, a thin cardboard sheet, etc. The flexible substrate 522 may be a reusable component, which can be reused by adhering a new (unused) adhesive film stack 130 to the flexible substrate 522, when all adhesive strips of a previous adhesive film stack have all been used. In another embodiment, the adhesive mounting member 520 may be a one-time usable component, which is replaced with a new adhesive mounting member 520 when all dry adhesive strips of the adhesive film stack 130 have all been utilized.

The embodiments described herein provide cover assemblies and mechanisms for mounting mobile computing devices to objects using dry adhesive structures (e.g., individual dry adhesive strips and/or dry adhesive strips of an adhesive film stack), while protecting the dry adhesive structures from being damaged or soiled when not in use. For example, in the embodiment shown in FIG. 1D, when the rigid cover member 120 is mounted to the flexible cover member 110, the adhesive film stack 130 is protected within the cavity 124 from being damaged and/or soiled when not in use. Similarly, in the embodiments of FIGS. 2A, 2B, 3A, and 3B, the dry adhesive structures are stored and protected within a covered cavity region 224 and 324 when not in use.

Further, with the embodiment of FIGS. 4A and 4B, the cover assembly 400 can be utilized for mounting purpose only, and then removed when the mobile computing device 140 is utilized normally while protected by the existing cover member 420. Similarly, with the embodiment of FIGS. 5A and 5B, the adhesive mounting member 520 can be removed and safely stored away when not in use, while allowing the cover member 510 to be utilized as a protective cover for a mobile computing device when not being used to adhere the device to an object.

These example embodiments are in contrast to other techniques in which a protective cover is fabricated with an integrated "sticky" backside surface that is integrally formed using a dry adhesive technology to allow the protective cover to be directly mounted to the surface of an object. With these other techniques, the "sticky" surface of the protective cover is continually exposed to the environment when the protective cover (mounted to a mobile computing device) is used in its normal capacity as a protective cover. In this regard, the "sticky" surface of the protective cover can quickly become dirty by various debris (dust, lint, dirt, other small debris) as the mobile computing device is utilized over time, which reduces or substantially blocks, the adhesion force of the integrated "sticky" surface of the protective cover. Moreover, this can be problematic in instances where a mobile computing device with a protective cover (having an integrated "sticky" surface) mounted thereto is stored in a purse, for example, where various objects can stick to the "sticky" surface of the protective device, thereby requiring constant removal of objects that are stuck to the "sticky" surface of the protective device when retrieving the mobile device from the purse.

Although exemplary embodiments have been described herein with reference to the accompanying figures, it is to be understood that the invention is not limited to those precise embodiments, and that various other changes and modifications may be made therein by one skilled in the art without departing from the scope of the appended claims.

What is claimed is:

1. A cover assembly for a mobile computing device, comprising:

a first protective cover configured to connect to a mobile computing device;

an adhesive film stack coupled to a backside of the first protective cover;

wherein the adhesive film stack comprises a stack of individual dry adhesive strips, wherein each individual dry adhesive strip is configured to adhere to a surface of a target object to mount the first protective cover to the surface of the object with the mobile computing device attached to the first protective cover; and a second protective cover which is configured to connect to the first protective cover and cover the backside of the first protective cover, wherein the second protective cover comprises a cavity region formed in an inner surface of the second protective cover, wherein the cavity region is configured to insertably receive the adhesive film stack when the second protective cover is mounted to the first protective cover.

2. The cover assembly of claim 1, wherein the first protective cover comprises a raised mesa member on the backside of the first protective cover, wherein the adhesive film stack is mounted on the raised mesa member.

3. The cover assembly of claim 1, wherein the first protective cover is formed of a flexible material, and wherein the second protective cover is formed of a rigid or semi-rigid material.

4. The cover assembly of claim 3, wherein the flexible material comprises rubber.

5. The cover assembly of claim 3, wherein the rigid or semi-rigid material comprises plastic.

6. A cover assembly for a mobile computing device, comprising:

a first protective cover configured to connect to a mobile computing device; and an adhesive film stack coupled to a backside of the first protective cover;

wherein the adhesive film stack comprises a stack of individual dry adhesive strips, wherein each individual dry adhesive strip is configured to adhere to a surface of a target object to mount the first protective cover to the surface of the object with the mobile computing device attached to the first protective cover;

wherein the first protective cover comprises:

a cavity region formed in the backside of the first protective cover; and a movable cover to open and close the cavity region;

wherein the cavity region is configured to store the adhesive film stack when the movable cover is positioned to close the cavity region.

7. The cover assembly of claim 6, wherein the movable cover is slidable.

8. The cover assembly of claim 6, wherein the movable cover is hingedly connected to the backside of the first protective cover, wherein the adhesive film stack is mounted to an inside surface of the movable cover.

9. A cover assembly for a mobile computing device, comprising:

a first protective cover configured to connect to a mobile computing device; and an adhesive film stack coupled to a backside of the first protective cover;

wherein the adhesive film stack comprises a stack of individual dry adhesive strips, wherein each individual dry adhesive strip is configured to adhere to a surface of a target object to mount the first protective cover to the surface of the object with the mobile computing device attached to the first protective cover; and wherein the first protective cover comprises a first slot and a second slot formed on the backside of the first protective cover, wherein the adhesive film stack is mounted to a flexible substrate member, wherein the adhesive film stack is coupled to the backside of the first protective cover by inserting first and second end portion of the flexible substrate member into the first and second slots, respectively, on the backside of the first protective cover.

10. The cover assembly of claim 1, wherein the individual dry adhesive strips of the adhesive film stack are separated by non-stick separation films.

11. The cover assembly of claim 1, wherein the individual dry adhesive strips of the adhesive film stack comprise stretch releasing pressure sensitive dry adhesive strips.

12. The cover assembly of claim 1, wherein the individual dry adhesive strips of the adhesive film stack comprise dry adhesive strips comprising synthetic setae.

13. The cover assembly of claim 6, wherein the individual dry adhesive strips of the adhesive film stack are separated by non-stick separation films.

14. The cover assembly of claim 6, wherein the individual dry adhesive strips of the adhesive film stack comprise stretch releasing pressure sensitive dry adhesive strips.

15. The cover assembly of claim 9, wherein the individual dry adhesive strips of the adhesive film stack are separated by non-stick separation films.

16. The cover assembly of claim 9, wherein the individual dry adhesive strips of the adhesive film stack comprise stretch releasing pressure sensitive dry adhesive strips.

* * * * *